United States Patent [19]

Kato

[11] Patent Number: 4,474,480

[45] Date of Patent: Oct. 2, 1984

[54] HAND TYPE MUSICAL TIMEPIECE

[75] Inventor: Yoshiaki Kato, Tanashi, Japan

[73] Assignee: Citizen Watch Co., Ltd., Tokyo, Japan

[21] Appl. No.: 536,776

[22] Filed: Sep. 28, 1983

[30] Foreign Application Priority Data

Oct. 1, 1982 [JP] Japan ..... 57-173728

[51] Int. Cl.[3] ..... G04B 19/04; G04B 21/00

[52] U.S. Cl. ..... 368/80; 368/223; 368/272

[58] Field of Search ..... 368/76, 80, 272, 273

[56] References Cited

U.S. PATENT DOCUMENTS

| | | | |
|---|---|---|---|
| 4,223,522 | 9/1980 | Nomura et al. | 368/80 |
| 4,368,989 | 1/1983 | Kawashima | 368/273 |
| 4,388,000 | 6/1983 | Hagihira | 368/273 |

*Primary Examiner*—Vit W. Miska

*Attorney, Agent, or Firm*—Sherman & Shalloway

[57] ABSTRACT

A hand type musical timepiece, namely, an analog musical timepiece comprising a hand adapted to be driven by a step motor for the visual indication of tones of a melody, a staff or a pattern of a keyboard formed on a plane extending adjacently to an imaginary plane to be swept by the hand, a melody playing device, and a normal-reverse rotation controller to move the hand in synchronism with the melody so that the hand indicates the position corresponding to the individual tone of the melody on the staff or on the keyboard. The time indicating operation and the tone indicating operation of the hand and the mode changeover operation are controlled by an exclusive circuit designed therefor and a programmed microcomputer.

8 Claims, 7 Drawing Figures

FIG. 1(a)
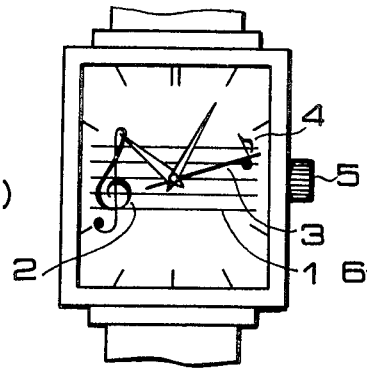
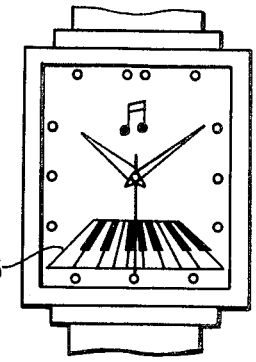
FIG. 1(b)
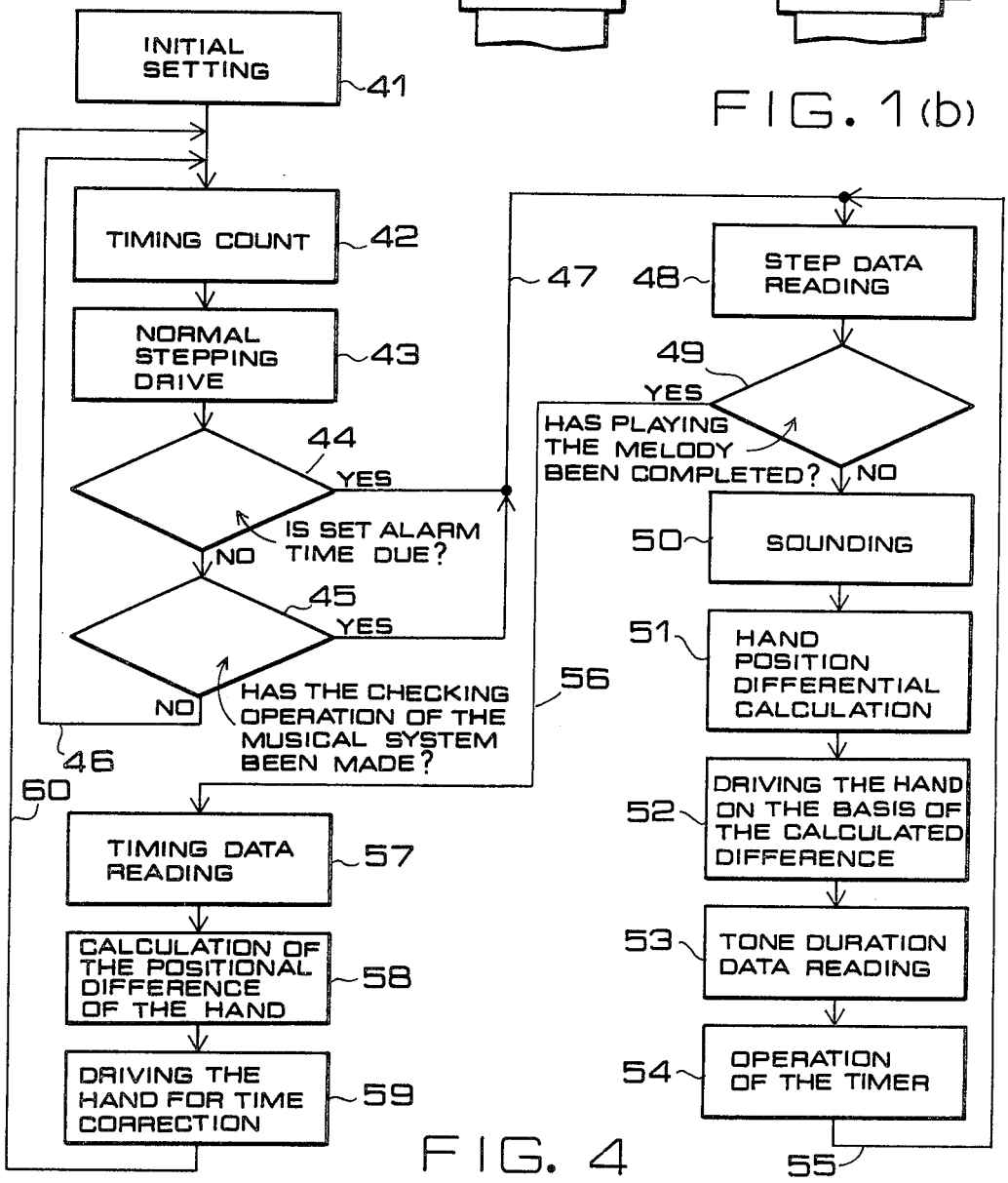
FIG. 4

HAND TYPE MUSICAL TIMEPIECE

BACKGROUND OF THE INVENTION

1. Field of the Invention

The present invention relates to a hand type electronic timepiece which is capable of playing a melody.

2. Description of the Prior Art

There have been proposed several timepieces capable of playing a melody and of visually and sequentially indicating every tone of the melody. All those timepieces of prior arts, however, are digital timepieces each having an electron-optical indicating function, such as a liquid crystal display. The tone indicating function of those conventional timepieces is exhibited, for example, by displaying a score fixedly in part of the time indicating surface, or by changing the normally displayed time indication into score indication, and the notes of the melody are electro-optically displayed on the score while the melody is being played.

Accordingly, even though visual melody display is provided specially, the display is not clear and not amusing due to the insufficient brightness of the liquid crystal display and the narrow area of display, and hence such conventional musical timepieces could not have been accepted by widely by the market. British patent application No. 8,027,416 (Publication No. 2,062,301) is illustrated as an example of the prior art.

SUMMARY OF THE INVENTION

Accordingly, it is an object of the present invention to provide a hand type musical timepiece, namely, an analog electronic timepiece having a musical function and capable of providing extremely bright, clear and easily colored display. In a hand type musical timepiece of the present invention, the hand or the hands are moved over a score drawn on the dial plate or on the cover glass, in synchronism with the progress of the melody. Thus, the hand type musical timepiece of the present invention provides sufficient dynamic amusement of dancing hands in addition to the brightness, colorfulness and the feeling of the high-grade of an analog timepiece, thus eliminating the serious disadvantage of the prior arts.

BRIEF DESCRIPTION OF THE DRAWINGS

The foregoing and other objects, advantages and features of the invention will be apparent from the following description of the preferred embodiments thereof, having reference to the accompanying drawings, in which:

FIGS. 1*a* and 1*b* are plan views of wrist watches, respectively, embodying the present invention;

FIGS. 2*a*, 2*b* and 2*c* are step motor driving waveform diagrams, in which FIG. 2*a* shows a waveform for normal rotation, while FIGS. 2*b* and 2*c* show waveforms for reverse rotation;

FIG. 4 is a flow chart serving as a guide in developing a program for a timepiece equipped with a microcomputer in accordance with another embodiment of the present invention.

DETAILED DESCRIPTION OF A PREFERRED EMBODIMENT

Figure 3:
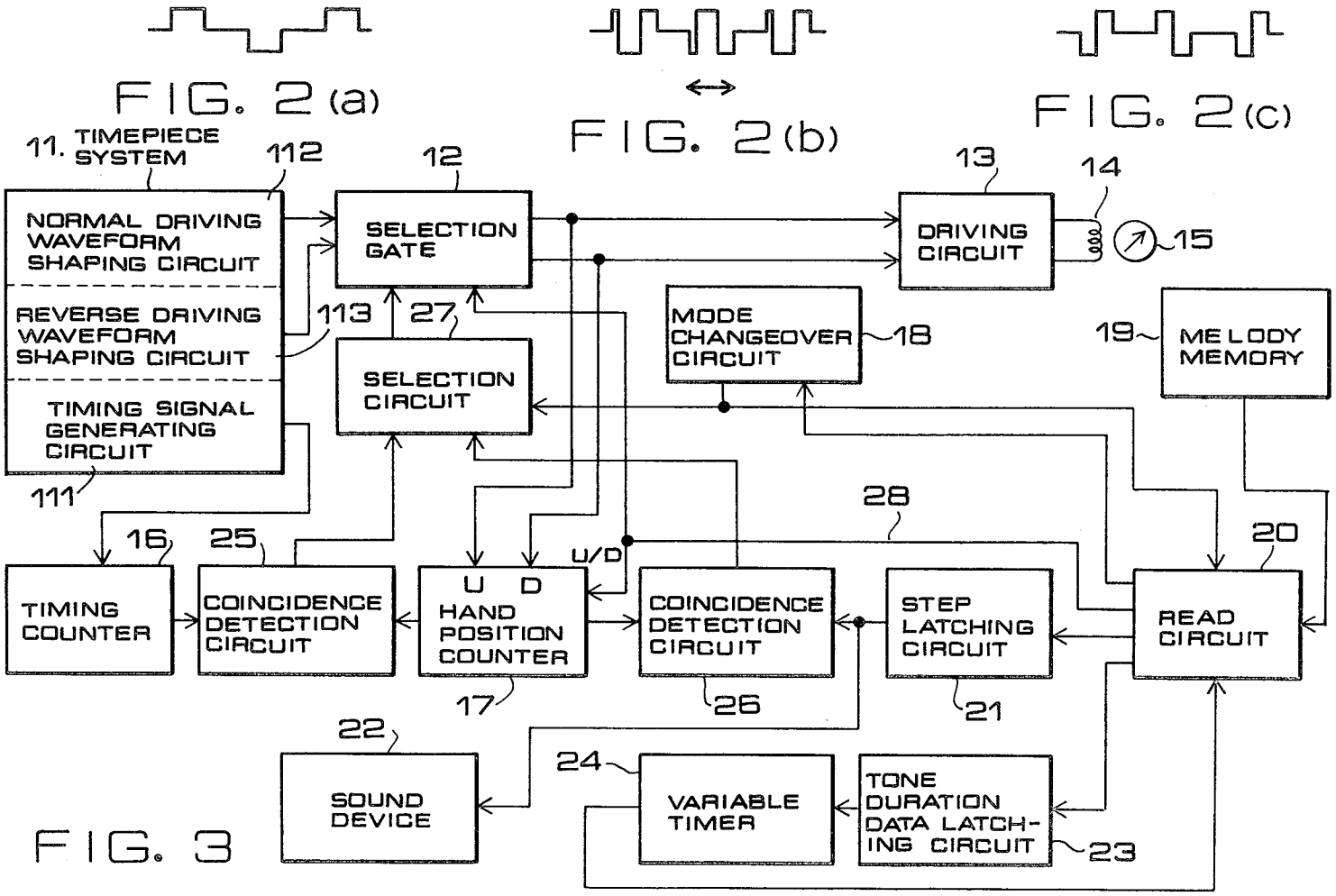
FIG. 3 is a block diagram of a system of an embodiment of the present invention.

Referring to FIG. 1*a* showing the appearance of a hand type wrist watch embodying the present invention, there are shown a staff 1 printed, for example, on the dial plate in printing the time scale and a G clef 2 (a time signature is added if necessary) also printed on the dial plate, which give a strong impression of the musical function of the watch. A hand 3 for indicating a musical step is provided at the middle or the extremity thereof, for example, with a clear eighth note 4. The provision of the note 4 which moves together with the hand 3 will intensify further the impression of the musical watch. In this embodiment, the second hand is used as the hand 3. During the normal operation of the watch, the hand 3 indicates the lapse of time in second by an angle of rotation. When a melody is played, the hand moves quickly to a predetermined position on the musical staff. An external operating member 5, such as a button or a stem, is provided for the manual operation of time indication correction, melody playing time setting and other necessary manual operations. When the reduction ratio of a gear train interlocking the output shaft of a built-in step motor of the watch and the shaft of the hand for indicating steps is not changed in particular between a normal time indicating mode and a melody playing mode, strictly speaking, the intervals between the adjacent lines of the staff are not the same. It is recommended that the interval is a number obtained by multiplying an integral multiple of the distance of movement of the step indicating part (the note or the extremity) of the hand at each stepped operation of the step motor, by the cosine of the angle between the hand and the staff. When the second hand of the watch is used as a time indicator, the correspondence of a step to 2 seconds will give an appropriate interval between the staff.

In this embodiment, the watch is a three-hand type watch as shown in FIG. 1*a*, however, the number of hands is not limited by the present invention, and hence other hand may be provided for indicating the step, or a hand adapted to be driven by a motor separate from the time indicating system may be provided for exclusively indicating the step. When a plurality of hands adapted to be driven by separate motors, respectively, are provided to indicate separate steps respectively, chords can be indicated, or a tone duration or the pattern of a sharp or of a flat can be indicated by one of the hands. The fixed scale lines may be drawn either on the dial plate or the cover glass, or may be displayed temporarily on a liquid crystal display device or an electrochromic display device arranged in parallel to the dial plate or the cover glass. When a liquid crystal display device or an electrochromic display device is employed, it is possible to provide only the head of the note and the tail of the note, a sharp or a flat may be displayed through electro-optical means. In such an arrangement, since actual notes are indicated by the hand, the notes will be perceived more clearly than in the conventional arrangement. In a modification shown in FIG. 1*b*, the hand indicates a key of a keyboard 6, corresponding to a note.

FIG. 2 shows waveforms of signals for driving a step motor for moving the hand. An exemplary step motor capable of being employed in the wrist watch is of the type which is employed in most analog quartz watches made in Japan, while comprises a rotor having a permanent magnet disk magnetized diametrically in two poles, a yoke enclosing the permanent magnet disk of the rotor, and a two-terminal driving coil capable of magnetizing the right and the left legs of the yoke at different magnetic potentials. The yoke and the magnetic disk of the rotor are formed so that the clearance between the circumference of the magnetic disk and the yoke is not uniform over the entire circumference of the magnetic disk, in order to locate the magnetic disk in alignment with a predetermined direction while the magnetic disk is not driven. When alternate driving current pulses each of short duration as shown in FIG. 2*a* are supplied to the driving coil of the step motor, the rotor is turned through an angle of 180° in the normal direction every supply of a current pulse. If the frequency of the current pulse is increased, for example, to 128 Hz, the rotor can be made to step quickly in the normal direction of rotation. When composite current pulses as shown in FIGS. 2*b* or 2*c* are supplied to the driving coil, the rotor is made to step through an angle of 180° in the reverse direction of rotation every one set of the composite current pulses. In FIG. 2, a range indicated by the double-headed arrow includes composite current pulses for one reverse stepping motion of the rotor. In driving the rotor in the reverse direction by the current pulses of these waveforms, the attractive force and the repulsive forces acting between the magnetic disk of the rotor and the yoke are controlled so that each current pulse is supplied to the driving coil at a timing in harmony with the vibration of the rotor. For example, the rotor can be made to step quickly in the reverse direction of rotation at a frequency of 64 Hz. The direction of current in each set of the composite current pulses changes also alternately. Such reversible motors and driving waveforms therefor are shown by U.S. Pat. Nos. 4,112,671 and 4,241,434.

FIG. 3 is the essential part of a block diagram of an embodiment of the present invention. A timepiece system 11 comprises a timing signal generating circuit 111 to generate a necessary timing signal, for example, one pulse per second, by dividing a pulse signal given by a reference frequency source, such as a quartz oscillator, a normal driving waveform shaping circuit 112 to generate a quick step signal for driving the rotor in the normal direction by combining the output signals given during the dividing operation of the timing signal generating circuit, and a reverse driving waveform shaping circuit 113 to generate a quick step signal for driving the rotor in the reverse direction. A selection gate 12 selects either the normal driving signal or the reverse driving signal and applies the selected driving signal to a driving circuit 13 in accordance with the required condition. The driving coil and the rotor of the step motor are indicated at 14 and 15 respectively. The driving circuit comprises a so-called steering flip flop circuit capable of discriminating the position of the pole of the rotor 15, namely, discriminating the direction of the diameter connecting the diametrically opposite N-pole and S-pole between two directions, an inverter capable of inverting the polarity of the next driving signal (one or one set), when necessary, according to the condition of the steering flip-flop circuit, and a current amplifying circuit to provide a driving current. A timing counter 16 counts the output signal of the timing signal generating circuit 111 to provide a reference signal for returning the hand, which has been deviated from its time indicating position for indicating the steps, to the time indicating position after the completion of playing the melody. A hand position counter 17, an up-down counter, to provide an electrical count corresponding to the existing position of the hand. The hand and the hand position counter are synchronized through a manual resetting operation when the hand indicates, for example twelve o'clock. The output signal of the normal driving waveform shaping circuit 112 and the output signal of the reverse driving waveform shaping circuit 113 are applied through the selection gate 12 to the up-input terminal and the down-input terminal, respectively, of the hand position counter. Naturally, the signals are masked to add or to subtract only one count for one step of the normal or the reverse direction, respectively, even if the signal is a composite driving signal. A mode changeover circuit 18 gives a signal to actuate the melody-playing function of the watch at an alarm generating time or when the manual switching operation is performed on occasion to inspect the melody-playing function of the watch. An IC memory 19 stores the step and the tone duration of each tone of the melody. A read circuit 20 reads out the combinations each of a step and a tone duration one by one. The read circuit 20 is actuated by an operation command signal given by the mode changeover circuit 18. The step data read out from the IC memory 19 is held by a step data latching circuit 21, and then applied to a sound device 22. The sound device 22 decodes the step data to convert the step data into the corresponding frequencies and further modulates the waveforms of the tones to provide a reverberation effect and sound a speaker provided on the back cover of the watch to play the melody. The tone duration data given by the read circuit 20 is held by a tone duration data latching circuit 23. The operating time of a variable timer 24 is controlled on the basis of the tone duration data to interrupt the read operation of the read circuit 20 for a predetermined time. The timer gives a signal to restart the read operation of the read circuit, and thereby the read circuit 20 reads out the next step data and tone data from the memory 19, which are latched, and then are applied to the sound device.

When the read circuit 20 receives a signal indicating the completion of playing the melody from the memory 19, a signal is given to the mode changeover circuit 18 to change the mode of the watch from the melody playing mode to the normal time indicating mode.

When the read circuit 20 receives a rest signal and rest duration data from the memory 19, the operation of the second device is interrupted for a period corresponding to the rest duration data, and the step data given immediately before the rest signal remains held by the latching circuit 21 or data corresponding to the position of the rest mark indicated on the dial plate is latched.

The memory circuit 19 and the read circuit 20 are capable also of giving a discrimination signal indicating the level of the present tone relative to the level of the preceeding tone.

A coincidence detection circuit 25 detects the coincidence of the count of the timing counter 16 and that of the hand position counter 17. Another coincidence detection circuit 26 detects the coincidence of the data held by the step data latching circuit 21 and the count of the hand position counter 17. A selection circuit 27 selects the output signal either of the coincidence detection circuit 15 or of the coincidence detection circuit 26 and sends the selected output signal to the selection gate 12. While the selected output signal represents an uncoincident state, the selection gate 12 allows a quick rotation signal to pass the selection gate 12, whereas the selection gate 12 is closed when the selected output signal represents a coincident state. The selection circuit 27 is controlled by the mode changeover circuit 18 so as to select the output signal of the coincidence detection circuit 25 and the output signal of the coincidence detection circuit 26 in the time indicating mode and in the melody playing mode respectively.

A signal 28, which is stored in the memory 19 as part of the individual tone data and is read out by the read circuit 20, representing either as ascending step or a descending step between two successive tones is applied to the selection gate 12 as an input signal for selection and to the hand position counter 17 as an up-down changeover input signal. When the signal 28 is an ascending step signal, the hand position counter 17 acts as an up-counter and the selection gate 12 allows a signal of normal quick-rotating waveform to pass the selection gate 12, whereas when the signal 28 is a descending step signal, the hand position counter 17 is changed over into a down-count mode and the selection gate 12 acts so as to allow only a signal of reverse quick-rotating waveform to pass the selection gate 12.

Naturally, during the normal time indicating mode, the selection gate 12 allows only the signal of normal rotating waveform. When the watch is changed over into the melody playing mode, the hand moves over the staff or over the keyboard in synchronism with the melody (the step data indicates the exact position of the notes) and after the completion of playing the melody, the position of the hand is corrected by taking into consideration the lapsed time while the melody is played so that the hand indicates correct time.

The embodiment as described hereinbefore is constituted by combining hardwares, namely, sectional circuits. Recently, watches or clocks of different functions are produced by replacing the timepiece circuit with a universal microcomputer system and providing the universal microcomputer system with a suitable program. FIG. 4 is a flow chart of such a microcomputer system controlled by such a program. At Step 41, necessary manual operation, such as a hand synchronizing operation, is performed. At Step 42, timing count, for example, the count of cumulative time in second, is performed. At Step 43, the hand is advanced by a predetermined number of steps to make the hand indicate time. At Steps 44 and 45, it is discriminated whether or not the timepiece is in the melody playing mode. When the clock is not in the melody playing mode, the program goes on through Loop 46 to repeat the timing and the hand stepping operations. When the timepiece is in the melody playing mode, the program is branched to a melody playing subroutine through Loop 47, then the steps stored in an attached memory is read at Step 48. At Step 49, it is discriminated whether or not playing the melody is completed. When the data read from the attached memory is not playing completion data, a sound device is actuated at Step 50. The difference between sound data and the data of the immediately preceeding position of the hand is calculated at Step 51. The hand is rotated quickly in the normal or the reverse direction corresponding to the calculated difference at Step 52. Tone duration data is read at Step 53. The advancement of the execution of the program is interrupted at Step 54 for a time corresponding to the tone duration data, and then the program goes on through Loop 55 to repeat the same melody playing cycle to sound the next tone. When data indicating the completion of melody playing is read at Step 48, the program is branched through Loop 56 to Step 57, where timing data is read. The difference between the timing data read at Step 57 and the existing position of the hand is calculated at Step 58 to drive the hand through an angle corresponding to the calculated difference at Step 59, and then the program is returned through Loop 60 to the normal timing cycle.

The basic operations of the embodiments of the present invention have been described hereinbefore. In many cases, the hand of a timepiece is used for various purposes to have the timepiece execute its other function, such as a set alarm time indicating function, a calendarial function or chronographical function, in addition to its normal time indicating function and a melody playing function. Any one of those functions is feasible on the basis of the fundamental gist of the present invention that the hand is driven appropriately according to the difference between a count representing the existing position of the hand and necessary data for various indications.

The present invention is capable of making a clock or a watch more functional, more enjoyable and more desirable, and hence the present invention is industrially of great utility value. Since the quick rotation of the hand is executed practically in a moment, delay in the quick rotation of the hand is scarcely of a matter of problem.

What is claimed is:

1. A hand type musical timepiece comprising a hand adapted to be driven by a step motor, a pattern indicating the height of a tone by a position such as a staff or a pattern of a keyboard formed on a plane extending adjacently to an imaginary plane to be swept by the hand, a melody playing device, and a normal-reverse rotation controller to move the hand in synchronism with a melody so that the hand indicates the position corresponding to the individual tone of the melody on the pattern of the staff or the keyboard.

2. A musical timepiece according to claim 1, the melody playing device further comprising a means for continuously reading tone data of each tone constituting the melody, and the controller further comprising a means for the difference between a new position of the hand corresponding to the read-out data and the present position of the hand which is read out immediately before the data and a means for fast-feeding the hand forwards or backwards by the detected difference in the hand position.

3. A musical timepiece according to claim 1 or 2, further comprising a function changeover means for changing the position of the hand from the time display condition to the musical interval upon arrival to an alarm set time and for returning the position of the hand to the time display condition upon completion of a musical performance.

4. A musical timepiece according to claim 1, wherein the hand has a musical note.

5. A musical timepiece according to claim 1, wherein the hand is a second hand.

6. A musical timepiece according to claim 5, wherein each interval of the staff corresponds to 2 seconds of the position of the second hand.

7. A musical timepiece according to claim 5, wherein each interval between keys in said pattern of the keyboard corresponds to 1 second of the position of the second hand.

8. A musical timepiece according to claim 1, wherein the operation of the hand and the musical performance of the timepiece are controlled by a programmed microcomputer.

* * * * *